United States Patent [19]

Salazar

[11] Patent Number: 5,063,818

[45] Date of Patent: Nov. 12, 1991

[54] FINGERBOARD FOR A FRETTED AND STRINGED INSTRUMENT

[76] Inventor: Jorge R. Salazar, 115-17 123 St., South Ozone Park, N.Y. 11420

[21] Appl. No.: 606,004

[22] Filed: Oct. 30, 1990

[51] Int. Cl.[5] ..... G10D 3/06

[52] U.S. Cl. ..... 84/314 R

[58] Field of Search ..... 84/290, 293, 314 N, 84/314 R, DIG. 30

[56] References Cited

U.S. PATENT DOCUMENTS 2,649,828 8/1953 Maccaferri ..... 84/314 R

*Primary Examiner*—L. T. Hix

*Assistant Examiner*—Howard B. Blankenship

*Attorney, Agent, or Firm*—Jordan and Hamburg

[57] ABSTRACT

A fingerboard construction for a stringed instrument such as a guitar employs a fret placement resulting in a sound characterized by perfect pitch octaves, fifths and fourths. According to the first fret placement, which begins by placing the twelfth fret, high E, exactly at half the distance between the nut and bridge of the fingerboard, perfect fourths can be found at exactly half the distance between their respective fifths.

2 Claims, 4 Drawing Sheets

RULE OF THE 18TH

WHOLE TONE SCALE

TEMPERED CHROMATIC SCALE

FIG. 2

CYCLE OF FIFTHS

| 5THS | 4THS | 5THS |
|---|---|---|
| E | A | E |
| A | D | A |
| D | G | D |
| G | C | G |
| C | F | C |
| F | Bb | F |
| Bb | Eb | Bb |
| Eb | Ab | Eb |
| Ab | (C#) Db | Ab |
| Db C# | Gb F# | Db C# |
| Gb F# | B | Gb F# |
| B | E | B |

FINGERBOARD FOR A FRETTED AND STRINGED INSTRUMENT

The present invention relates to a fingerboard for a fretted and stringed instrument such as a guitar and more particularly to a fingerboard construction employing a fret placement resulting in a sound characterized by perfect pitch.

BACKGROUND OF THE INVENTION

Fret positions on the fingerboard of a stringed instrument such as a guitar are laid out according to a traditional formula known as the Rule of the Eighteenth, according to which vibrating string length, i.e., the distance from the nut to the bridge of the guitar, is divided by 18 to locate the first fret spaced from the nut. The remaining string length, i.e., the distance from the first fret to the bridge, is again divided by 18 to locate the second fret. This formula is repeated until all of the frets are placed on the fingerboard.

Unfortunately, the Rule of the Eighteenth is only an approximately accurate method for determining fret placement and does not result in perfect pitch for the tones produced when a string is engaged with a fret and the remaining string length vibrated.

An alternative method for fret placement has been employed, known as the Whole Tone Scale. In the Whole Tone Scale, the distance from the nut to the bridge is divided by 9 to locate the first whole-tone fret spaced from the nut. The remaining string length is then divided by nine to locate the second whole-tone fret. In similar fashion to the Rule of the Eighteenth, this formula of dividing remaining string length by 9 is repeated until all of the frets for producing whole tones are placed on the fingerboard. The Whole Tone Scale suffers from a similar deficiency in that the fret placement does not result in perfect whole tones when the strings are vibrated.

Accordingly, the need still exists for a fingerboard construction for a fretted and stringed instrument such as a guitar which will achieve perfect pitch for the tones produced when a string is engaged with a given fret and the remaining string length vibrated.

SUMMARY OF THE INVENTION

An object of the present invention is to provide a fingerboard construction for a fretted and stringed instrument such as a guitar which will result in perfect pitch for every note or tone played on the instrument.

A further object of the present invention is to provide a fingerboard construction for a fretted and stringed instrument such as a guitar which will result in perfect octaves, fourths and fifths when a string is engaged with a fret and the remaining string length vibrated.

These and other objects are achieved, in accordance with the present invention, by a fingerboard construction for a stringed instrument such as a guitar having a nut, a bridge, a neck connecting the nut and the bridge and a fingerboard mounted on the neck and extending from the nut to the bridge, characterized in that a plurality of frets are sequentially mounted transversely on the fingerboard such that: 1) a first fret through a twelfth fret correspond to an octave of halftones and the twelfth fret is mounted equidistant between an inside face of the nut and an inside face of the bridge as measured along a symmetric center line on the fingerboard extending from the inside face of the nut to the inside face of the bridge; 2) each fret corresponding to an interval of a fourth degree is mounted equidistant between frets corresponding to respective intervals of fifth degrees as measured along the symmetric center line; and 3) any one of the first twelve frets corresponding to a given half-tone is mounted at a distance from the nut equal to twice the distance from the twelfth fret to a fret corresponding to the given half-tone up one octave.

The present invention provides a fret placement on a fingerboard resulting in a natural division of half-tones as imposed by nature. This natural division, referred to herein as a tempered chromatic scale, provides perfect pitch for any half-tone played on the instrument by engaging a string with a fret and vibrating the remaining string length.

BRIEF DESCRIPTION OF THE DRAWINGS

The present invention will now be described in conjunction with the accompanying drawings, in which:

FIG. 2 is a chart outlining the Cycle of Fifths;

DESCRIPTION OF THE PREFERRED EMBODIMENTS

Figure 1A:
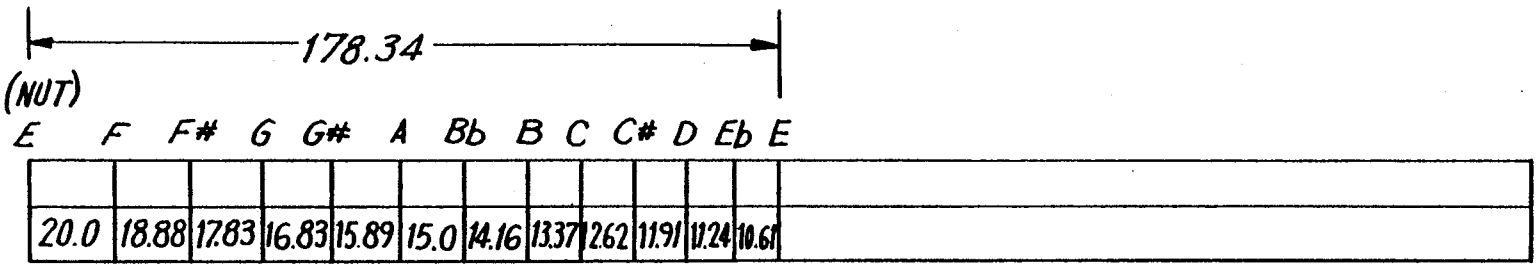
FIG. 1A PRIOR ART
FIGS. 1A, 1B, and 1C are schematic top view comparisons of guitar fingerboards made according to prior art methods and the present invention.

The construction of a fingerboard in accordance with the present invention, fret by fret, to obtain the tempered fret division and tempered chromatic scale of the present invention will now be described, with reference particularly to FIG. 3, which is a schematic top view of a fingerboard, and FIG. 2, which is a chart outlining the Cycle of Fifths.

For purposes of this embodiment, a standard guitar string assembly is employed as the reference base. Specifically, as shown in FIG. 3, in the standard guitar, six strings (not shown) are strung between a nut 10 and a bridge 20 over a fingerboard 30 therebetween having mounted transversely thereon a plurality of frets 40 in spaced relation. Each string, referred to as the first through the sixth string, when vibrated in an "open" fashion, i.e., over its entire length between nut 10 and bridge 20, corresponds respectively to one of the following pitches: E, B, G, D, A, and low E.

Considering, then, that the first string, whose open string tone is E, is used as the base for the scale of tones and thus fret placement on the guitar fingerboard 30, the first requirement is that a first fret 40 through a twelfth fret 40 correspond to an octave of half-tones. Accordingly, if the open string corresponds to E and the twelfth fret corresponds to high E, the half-tones from the nut to the twelfth fret, as shown in FIG. 3, correspond to the following half-tones, as is well-known:

| FRET | HALF-TONE |
|---|---|
| Nut | E |
| First | F |

-continued

| FRET | HALF-TONE |
|---|---|
| Second | F# |
| Third | high G |
| Fourth | high G# ($A_b$) |
| Fifth | high A |
| Sixth | high $B_b$ |
| Seventh | high B |
| Eighth | high C |
| Ninth | high C# ($D_b$) |
| Tenth | high D |
| Eleventh | high $E_b$ |
| Twelfth | high E |

These twelve frets correspond to standard tones on a guitar. However, in accordance with the present invention, the frets are located on the fingerboard so that perfect pitch is achieved for each of the tones.

The first rule to be followed in order to achieve this natural division of tones according to nature is that the twelfth fret (high E) is mounted precisely equidistant between the inside face of the nut 10 and the inside face of the bridge 20 as measured along a symmetric center line 50 on the fingerboard 30 extending from the inside face of the nut to the inside face of the bridge 20.

The length of a standard fingerboard, i.e., the standard actual distance between the nut 10 and the bridge 20 of a guitar is 656 mm. However, in accordance with the present invention, the total actual length of the fingerboard can be divided into any arbitrary number of equal units and fret placement calculated based on the arbitrary preselected number of equal units.

For purposes of the present explanation, then, let us assume that the actual length of fingerboard 30 from the inside face of nut 10 to the inside face of bridge 20 is divided into 360 equal units, i.e., 360 mm, 360 degrees, or 360 of any name designation. This total longitude of 360 equal units will be used as the basis for determining fret placement on the fingerboard 30 shown in FIG. 3.

Figure 3:
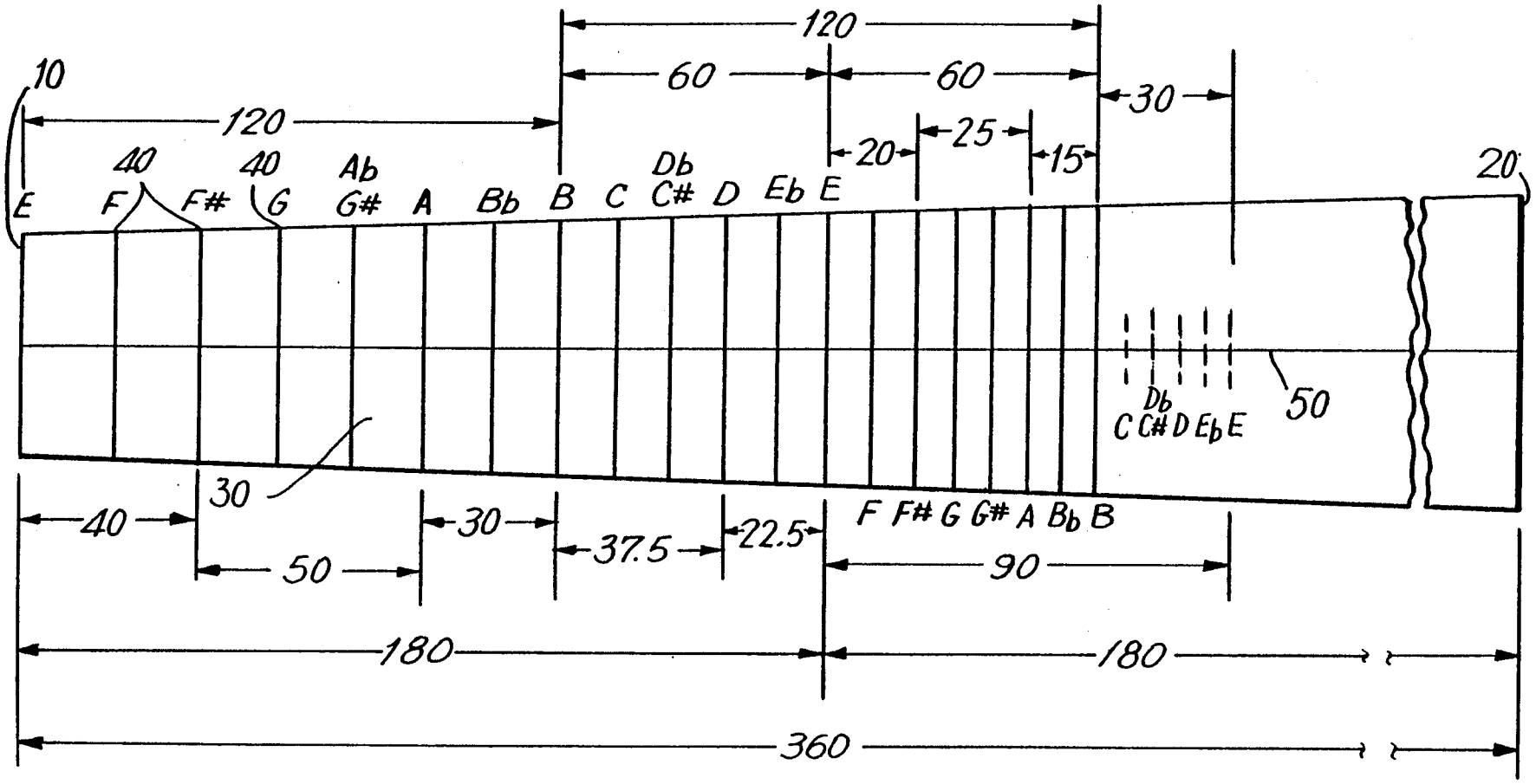
FIG. 3 is a schematic top view of a guitar fingerboard made in accordance with the present invention.

Accordingly, if the twelfth fret (high E) is to be mounted exactly equidistant between the nut 10 and the bridge 20, and the total longitude is 360 units, then the twelfth fret is mounted at precisely 180 units (360 units divided by 2) from the inside face of nut 10, as shown in FIG. 3.

Thus, the exact mid-point of the total longitude of the fingerboard measured along symmetric center line 50, i.e., 180 units, is exactly where the twelfth fret is mounted. This twelfth fret is the higher octave (high E) of the tone produced by the open string (E). Moreover, since the fret is placed equidistant between the nut 10 and the bridge 20, the same number of vibrations result when the string is engaged with the twelfth fret and the string vibrated on either side of the fret.

The second rule to be employed in accordance with the present invention is that frets 40 corresponding to an interval of a fourth degree (fourths) are mounted precisely equidistant between frets corresponding to respective intervals of fifth degrees (fifths) as measured along the symmetric center line 50.

The Cycle of Fifths is shown in FIG. 2. In the FIG. 2 chart, the left-hand column lists the lower fifth, the middle column lists the respective fourth and the right-hand column lists the higher fifth.

Thus, as readily apparent from FIG. 2, high A is a fourth interval between the fifths E and high E. Similarly, high D is the fourth between the fifths High A and Double A, high G is the fourth between the fifths high D and Double D, and so forth down the chart. As will become readily apparent, the Cycle of Fifths is used repeatedly to determine the exact placement for a variety of the frets 40 on the fingerboard 30.

Thus, since high A is a fourth between the two fifths E (nut) and high E (twelfth fret), the fret for A (fifth fret) is mounted equidistant between the nut and the twelfth fret, or 180 divided by 2, 90 units from the nut, as shown in FIG. 3. Accordingly, the distance measured 5 frets to the left of the fifth fret (towards nut 10) equals the distance measured 7 frets to the right of the fifth fret (towards bridge 20).

Next, the total length from the nut 10 to bridge 20 is divided into thirds. The first third, in this case 360 divided by three (120 units from the nut 10) is the exact point for placement of the seventh fret, and its pitch is high B, which is an interval of a perfect fifth from open E and high E. In other words, as is well known and as shown in FIG. 2, high E is the fourth between the two fifths high B and double B. Since, according to the present invention, fourths lie equidistant between two respective fifths, and high B has been mounted exactly 60 units down from high E towards the nut 10, then double B must be mounted exactly 60 units up from high E towards the bridge 20, or 240 units as measured from the nut 10, as shown in FIG. 3.

This also illustrates the third rule to be followed in order to obtain the tempered chromatic scale of the present invention. Specifically, the third rule requires that each of the first through twelfth frets 40 representing a given half-tone in an octave of half-tones is mounted at a distance from the nut 10 equal to twice the distance from the twelfth fret up to a fret 40 corresponding to the given half-tone up one octave.

As shown in FIG. 3, the thirteenth fret through twenty fourth fret together correspond to an octave of half-tones, each half-tone being one octave up from its corresponding half-tone in the first fret through twelfth fret. According to the third rule articulated above, each of these second octave frets are mounted at a distance from the twelfth fret, measured along the symmetric center line 50, which is one-half the distance its corresponding fret in the lower first octave is mounted from the nut 10.

The placement of double B described above will illustrate this principle. High B (seventh fret) is mounted on fingerboard 30 exactly 120 units measured from the nut along symmetric center line 50. Correspondingly, double B (nineteenth fret) is mounted exactly 60 units measured from the twelfth fret, or one-half the distance between the nut 10 and high B (seventh fret).

Now that high B and double B have been placed, the frets corresponding to F# (second fret) and high F# (fourteenth fret) can be placed. Specifically, F# (second fret) is mounted exactly at one-third the distance from the nut 10 to the seventh fret (high B), or at 40 units as measured from the nut 10 along the symmetric center line. The distance from F# to high B is thus 80 units (second fret to seventh fret). Since fourths lie exactly equidistant between two fifths and, as apparent from FIG. 2, high B is the fourth corresponding to the two fifths F# and high F#, high F# (fourteenth fret) must be mounted at exactly 80 units up from high B (seventh fret).

As can be seen from FIG. 3, this placement complies with all of the rules previously set forth. Thus, high B (seventh fret) lies exactly equidistant (80 units) between its respective fifths F# (second fret) and high F# (fourteenth fret). Moreover, F# (second fret) is located 40 units from the nut 10, which is exactly twice the distance from high E (twelfth fret) to high F# (fourteenth fret) (20 units).

The remaining frets 40 are mounted on fingerboard 30 using the above-noted rules. The result is placement of the frets on fingerboard 30 such that perfect pitch is achieved for any tone played by engaging the string with a fret 40 and vibrating the remaining string length.

Thus, since high A (fifth fret) has been mounted, double A (seventeenth fret) can now be mounted. Specifically, if high A (fifth fret) is placed at exactly 90 units measured from the nut, then double A (seventeenth fret) must be mounted at 45 units exactly measured from the twelfth fret (high E). This in accordance with the third rule that the distance from the nut 10 to the fret for any half-tone in the first octave of half-tones is twice the distance from the twelfth fret to the fret corresponding to that half-tone up one octave.

At this point, high A (fifth fret) and its octave double A have been mounted on fingerboard 30. Applying the basic principle that fourth lie exactly equidistant between two fifths, the tenth fret, whose half-tone is high D, is placed exactly equidistant between the following two fifths: high A (fifth fret) and double A (seventeenth fret). Since the fifth and seventeenth frets are spaced by a total of 135 units, the tenth fret is thus placed exactly 67.5 units as measured from the fifth fret towards the seventeenth fret, or vice versa.

There are eight intervals in the key of A, which is the key illustrated in this embodiment. Specifically, the first through the eighth intervals are, respectively, E, F#, G#, A, B, C#, D and E, as is well-known. In accordance with the present invention, there are four instances of fret placement on fingerboard 30 where the distance from a first interval to a second interval is exactly one-half the distance from the second interval to a fifth interval.

In the present embodiment, these four instances are as follows: 1) the distance from open E (nut) to F# (second fret) (40 units) is one-half the distance from F# to high B (seventh fret) (80 units); 2) the distance from high A (fifth fret) to high B (seventh fret) (30 units) is one-half the distance from high B to high E (twelfth fret) (60 units); 3) the distance from high D (tenth fret) to high E (twelfth fret) (22.5 units) is one-half the distance from high E to double A (seventeenth fret) (45 units); and 4) the distance from high E (twelfth fret) to high F# (fourteenth fret) (20 units) is half the distance from high F# to double B (nineteenth fret) (40 units).

In the present embodiment, wherein 360 equal units are employed as the total longitude between the inside face of the nut 10 and inside face of the bridge 20 for calculating the placement of all frets 40 on fingerboard 30, the third rule stipulating that any one of the first twelve frets 40 corresponding to a half-tone be mounted at a distance from the nut equal to twice the distance from the twelfth fret to a fret corresponding to that half-tone up one octave, results in the following exact placement of the following frets:

| FRET | HALF-TONE | PLACEMENT (in units) |
|---|---|---|
| 12th | high E | 180 from nut |
| 7th | high B | 120 from nut |
| 5th | high A | 90 from nut |
| 2nd | F# | 40 from nut |

-continued

| FRET | HALF-TONE | PLACEMENT (in units) |
|---|---|---|
| 10th | high D | 157.5 from nut |
| 24th | double E* | 90 from 12th fret |
| 19th | double B | 60 from 12th fret |
| 17th | double A | 45 from 12th fret |
| 14th | high F# | 20 from 12th fret |
| 22nd | double D* | 78.75 from 12th fret |

*the 20th through 24th frets are seldom used in practice.

It should be noted that for placement of the remaining frets 40, extreme care must be exercised in calculating and marking the points for placement of the frets, and divisions between frets 40, exactly. It is very difficult to place the remaining frets exactly. This is because, first, the calculations of units (based on 360 total units) at this point involves fractions progressively becoming smaller and smaller, eventually going into the hundredths and thousandths of a single unit. While such calculations can theoretically be exact at this minute level, manual placement of the fret exactly at a hundredth or a thousandth of a unit is difficult, if not impossible. Nevertheless, since the variations in placement due to human error at this point involve extremely small distances, perfect pitch is still attained by careful approximate placement.

Double G (fifteenth fret) is the next to be placed. The longitude from the tenth fret (high D) to the bridge 20 is divided by four, which in this embodiment is 202.5 units divided by four, or 50.625 units. The fifteenth fret is thus mounted exactly 50.625 units from the tenth fret, and its half-tone is double G.

Now the third fret (high G) can be mounted on fingerboard 30. The distance from the nut (open first string E) to the third fret (high G) must be twice the distance from the twelfth fret (high E) to the fifteenth fret (double G). Accordingly, the third fret (high G) is mounted on fingerboard 30 exactly at twice the number of units measured from the nut 10 towards the bridge 20 along symmetric center line 50 as the fifteenth fret is located from the twelfth fret, both of which are in place on fingerboard 30.

Considering the Cycle of Fifths shown in FIG. 2, the half-tone high C is a fourth with respect to the two fifths high G and double G. Accordingly, the eighth fret, whose half-tone corresponds to high C, is mounted exactly equidistant between the third fret (high G) and the fifteenth fret (double G).

The twentieth fret (double C) is the next to be placed. The distance from the nut 10 to the eighth fret (high C) is divided by two. The twentieth fret (double C) is mounted at a distance from the twelfth fret (high C) equal to one-half the distance from the nut 10 to the eighth fret, in accordance with the principle that the distance from the nut 10 to the fret corresponding to high C (eighth fret) must be twice the distance from the twelfth fret (high E) to the fret corresponding to high C up one octave (twentieth fret: double C).

Now that the frets corresponding to high C and Double C are in place on fingerboard 30, the thirteenth fret (high F) can be placed by applying the Cycle of Fifths. As shown in FIG. 2, high F is a fourth with respect to the fifths high C and Double C. Accordingly, the thirteenth fret (high F) is mounted on fingerboard 30 exactly equidistant between the eighth and twentieth frets.

The first fret (F) can now be placed. The thirteenth fret (high F) must appear at the mid-point between the first fret (F) and bridge 20.

The remaining frets are similarly placed by employing the basic rules articulated above.

Thus, as shown in FIG. 2, high B flat is a fourth with respect to the fifths F (first fret) and high F (thirteenth fret). Accordingly, the sixth fret (high B flat) is placed on fingerboard 30 exactly equidistant between the first and thirteenth frets. The eighteenth fret (double B flat) is placed exactly equidistant between the sixth fret (high flat) and the bridge 20. The eleventh fret (high E flat) is placed at a distance equidistant between the sixth and eighteenth fret, since E flat, as apparent from the Cycle of Fifths, is the fourth with respect to the fifths high B flat and double B flat. This corresponds to a distance measured from the sixth fret (high B flat) equal to one-fourth the distance measured from the sixth fret to the bridge 20. The sixteenth fret (double A flat) is placed at a distance measured from the eleventh fret (high E flat) equal to one-fourth the distance measured from the eleventh fret to the bridge. The fourth fret (high A flat) is placed at a distance from the nut equal to twice the distance from the twelfth fret (high E) to the sixteenth fret (double A flat). The ninth fret (C# or D flat) is a fourth with respect to the fifths high A flat and double A flat, and accordingly, is located equidistant the fourth and sixteenth frets. The twenty-first and twenty-third frets (double C# and double E flat, respectively) can, if desired, be similarly placed. However, placement of the twentieth through twenty fourth frets is not essential, as they are seldom used in practice. Theoretically, the twenty-fourth fret (double E) is placed at 270 units from the nut. This is because, if the first octave of twelve half-tones is placed within the first 180 units of the total 360 units, and the second octave of twelve halftones must be spaced at half the distance, the twenty-fourth or last fret of the second octave must be placed at 90 units measured from the twelfth fret, or at a total of 270 units from the nut 10.

The present invention thus provides a fingerboard for a stringed and fretted instrument such as a guitar which is characterized by a fret placement resulting in perfect pitch, fourths and fifths, thus correlating with the natural laws of tonality imposed by nature.

Figure 1B:
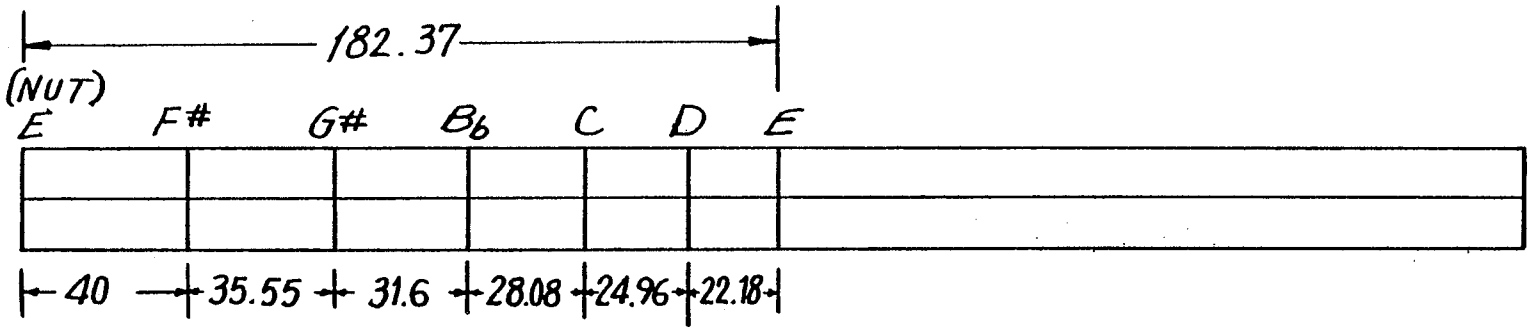
FIG. 1B PRIOR ART
Figure 1C:
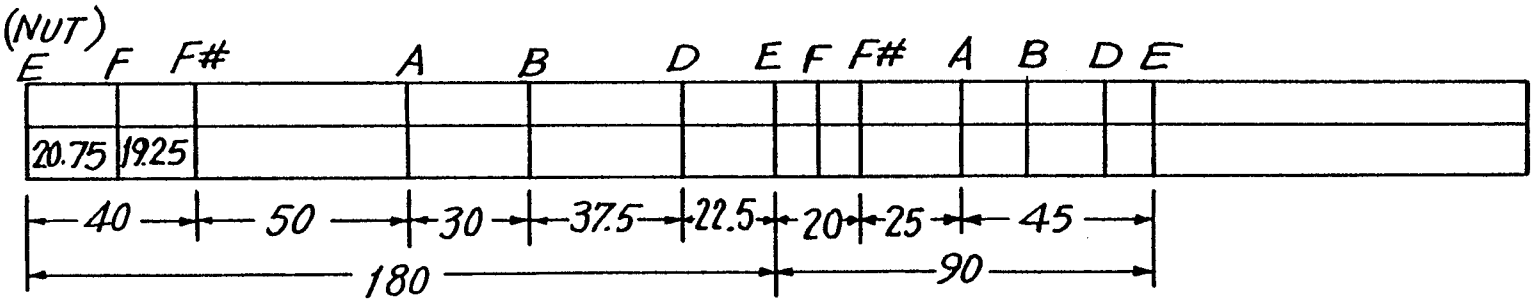

FIG. 1 schematically illustrates the fingerboard of the present invention in comparison to well-known prior art fingerboards previously described, the Rule of the Eighteenth and the Whole Tone Scale. As is readily apparent from FIG. 1, for a total fingerboard length of 360 equal units, fret placement varies depending on the system employed. Using the Rule of the Eighteenth, the twelfth fret (high E) is located at 178.34 units measured from the nut. Using the Whole Tone Scale, the twelfth fret (high E) is located at a distance of 182.37 units measured from the nut. According to the present invention, the twelfth fret (high E) is located at a distance of 180 units measured from the nut. Only the twelfth fret as placed in accordance with the invention results in a perfect pitch high E when the first guitar string (open E) is engaged with the twelfth fret and the remaining string length vibrated. The same number of vibrations are produced, moreover, when the string is vibrated on either side of the twelfth fret.

Using the Rule of the Eighteenth, the placement of the frets is as follows: nut to first fret (20.0 units); first to second fret (18.88 units); second to third fret (17.83 units); third to fourth fret (16.83 units); fourth to fifth fret (15.89 units); fifth to sixth fret (15.0 units); sixth to seventh fret (14.16 units); seventh to eighth fret (13.37 units); eighth to ninth fret (12.62 units); ninth to tenth fret (11.91 units); tenth to eleventh fret (11.24 units); eleventh to twelfth fret (10.61 units).

Using the Whole Tone Scale, the placement of the frets is a follows: nut to second fret (40 units); second to fourth fret (35.55 units); fourth to sixth fret (31.6 units); sixth to eighth fret (28.08 units); eighth to tenth fret (24.96); tenth to twelfth fret (22.18).

Using the Tempered Chromatic Scale of the present invention, the placement of the frets is as follows: nut to first fret (20.75 units); first to second fret (19.25 units); second to fifth fret (50 units); fifth to seventh fret (30 units); seventh to tenth fret (37.5 units); tenth to twelfth fret (22.5 units).

The Tempered Chromatic Scale of the present invention results in perfect pitch, whereas the prior art systems results in tones which are off pitch. The difference resides in the precise and exact placement of the frets on the fingerboard as called for by the present invention. Each system results in unique fret placement. Only the fret placement of the present invention results in perfect pitch for each and every half-tone in the octave.

EXAMPLE

A guitar fingerboard was constructed in accordance with the present invention by applying the rules articulated hereinbefore. The following fret placement resulting using a total unit measurement of 360 equal units from the nut to the bridge and taking into account human error involved in the calculations and actual fret placement as they proceeded from fret to fret:

| DISTANCE | FRET HALF-TONE | MEASUREMENT (units) |
|---|---|---|
| FIRST OCTAVE | | |
| nut to first fret | E to F | 20.75 |
| 1st fret to 2nd fret | F to F# | 19.25 |
| 2nd fret to 3rd fret | F# to G | 17.5 |
| 3rd to 4th fret | G to G# ($A_b$) | 16.5 |
| 4th to 5th fret | G# to A | 16.0 |
| 5th to 6th fret | A to $B_b$ | 15.56 |
| 6th to 7th fret | $B_b$ to B | 14.44 |
| 7th to 8th fret | B to C | 13.0 |
| 8th to 9th fret | C to C# ($D_b$) | 12.5 |
| 9th to 10th fret | C# to D | 12.0 |
| 10th to 11th fret | D to $E_b$ | 11.75 |
| 11th to 12th fret | $E_b$ to E | 10.75 |
| SECOND OCTAVE | | |
| 12th to 13th fret | E to F | 10.375 |
| 13th to 14th fret | F to F# | 9.625 |
| 14th to 15th fret | F# to G | 8.75 |
| 15th to 16th fret | G to Ab | 8.25 |
| 16th to 17th fret | $A_b$ to A | 8.0 |
| 17th to 18th fret | A to $B_b$ | 7.78 |
| 18th to 19th fret | $B_b$ to B | 7.22 |
| * | | |
| nut to 24th fret | E to double E | 270 |

* The 20th through 24th frets are seldom used and were not placed on the exemplified fingerboard.

Figure 4:
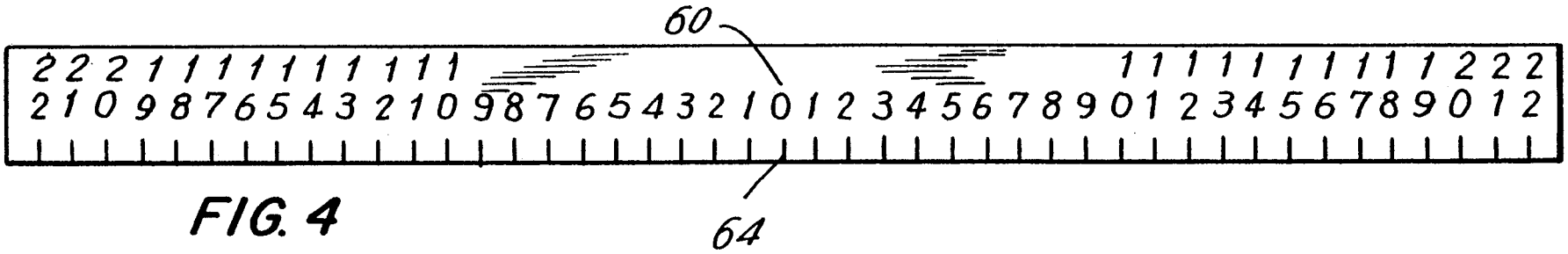
FIG. 4 is a top schematic view of a measuring device for use in laying frets accurately on a fingerboard in accordance with the present invention.
Figure 5:
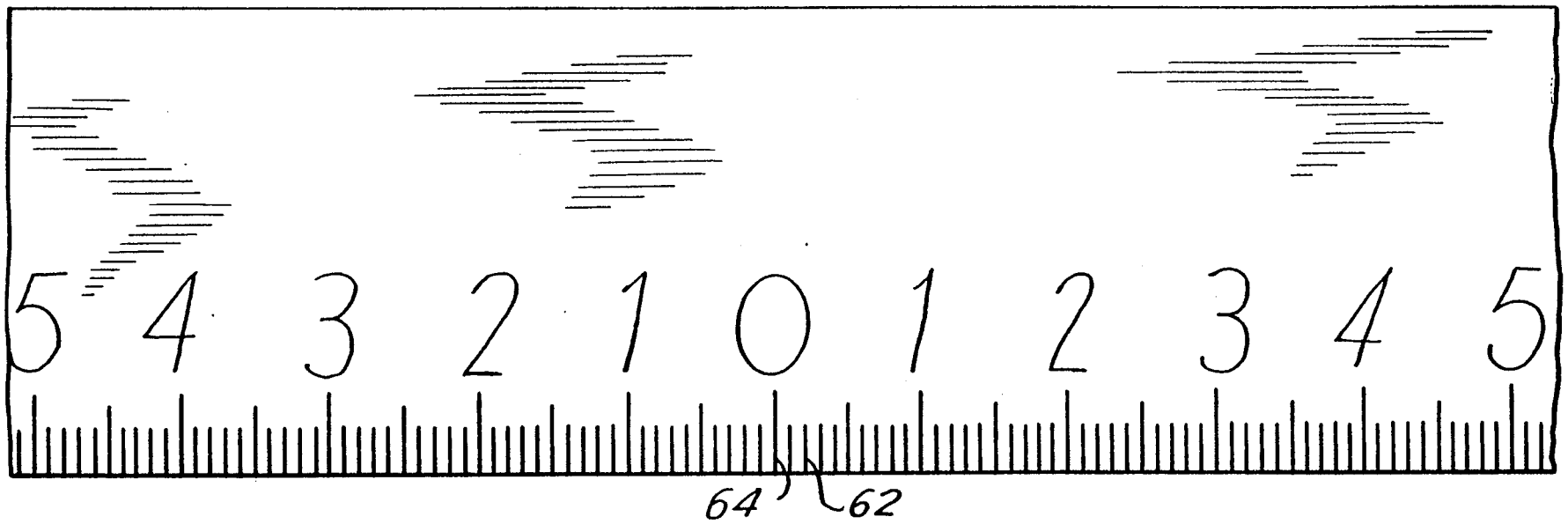
FIG. 5 is a top schematic enlarged view illustrating details of a section of the measuring device shown in FIG. 4.

FIGS. 4 and 5 schematically illustrate a measuring device for use in laying frets accurately on a fingerboard in accordance with the present invention.

As shown in FIGS. 4 and 5, the measuring device is a ruler generally designated at 60 having a series of gradations 62 thereon, each gradation 62 being spaced an identical amount from adjacent gradations. In other words, the distance between adjacent gradations is always the same, as in standard rulers. However, the ruler is characterized by a central 0-point 64. The gradations are marked identically in both directions extending from central 0-point 64. Thus, every ten gradations to the right of central 0-point 64 are marked consecutively: 1 through 22. Similarly, every ten gradations to the left of central 0-point 64 are consecutively marked: 1 through 22.

Measuring device 60 is ideally suited for use in mounting frets on a fingerboard in accordance with the present invention. For example, since one of the basic rules is that fourths lie equidistant between fifths, the measuring device can be employed to insure the accuracy of placement by placing the central 0-point 64 on the fret corresponding to the fourth. The fifths on either side of the fourth should fall at precisely the same gradation on either side of the central 0-point.

While the present invention has been described with respect to certain embodiments, it will be readily appreciated that such embodiments are merely illustrative and not limitative. For example, while the total distance between the nut and the bridge in the exemplified fingerboard was divided into 360 equal units as a base for fret calculation and placement, it will be readily appreciated that any desired total longitude may be employed, so long as each unit within the total longitude represents an equal amount. Thus, the standard distance of 656 mm between the nut and bridge of a standard guitar may be used as the base, or any other preselected total longitude of equal segments. The total longitude of 360 units was employed in the described embodiment because it is a preferred total for the fret placement calculations required by the present invention, calculations which become increasingly complex and involve increasingly minute measurements with the placement of each additional fret on the fingerboard.

What I claim is:

1. A fingerboard construction for a stringed instrument such as a guitar, said guitar having a nut, a bridge, a neck connecting said nut and said bridge, and a fingerboard mounted on said neck and extending from said nut to said bridge, said fingerboard comprising a plurality of frets sequentially mounted transversely on said fingerboard such that 1) twelve frets comprising a first fret through a twelfth fret correspond to an octave of half-tones and said twelfth fret is mounted equidistant between an inside face of said nut and an inside face of said bridge as measured along a symmetric center line on said fingerboard extending from the inside face of said nut to the inside face of said bridge, 2) each fret corresponding to an interval of a fourth degree is mounted equidistant between frets corresponding to respective intervals of fifth degrees as measured along said symmetric center line, and 3) each of said first fret through said twelfth fret corresponding to a given half-tone is mounted at a distance from said nut equal to twice the distance from said twelfth fret to a fret corresponding to the given half-tone up one octave.

2. A method for making a fingerboard for a stringed instrument such as a guitar having a nut, a bridge, a neck connecting said nut and said bridge, and a fingerboard mounted on said neck and extending from said nut to said bridge, comprising mounting a plurality of frets sequentially and transversely on said fingerboard such that 1) twelve frets comprising a first fret through a twelfth fret correspond to an octave of half-tones and said twelfth fret is mounted equidistant between an inside face of said nut and an inside face of said bridge as measured along a symmetric center line on said fingerboard extending from the inside face of said nut to the inside face of said bridge, 2) each fret corresponding to an interval of a fourth degree is mounted equidistant between frets corresponding to respective intervals of fifth degrees as measured along said symmetric center line, and 3) each of said first fret through said twelfth fret corresponding to a given half-tone is mounted at a distance from said nut equal to twice the distance from said twelfth fret to a fret corresponding to the given halftone up one octave.

* * * * *